United States Patent [19]

Ozawa et al.

[11] 4,078,536

[45] Mar. 14, 1978

[54] IGNITION SYSTEM WITH BACKFIRE PREVENTION

[75] Inventors: Max K. Ozawa, Portland; Allan J. Vanderzanden, Cornelius; Jerome F. Moshofsky, Portland, all of Oreg.

[73] Assignee: Hyster Company, Portland, Oreg.

[21] Appl. No.: 702,873

[22] Filed: Jul. 6, 1976

[51] Int. Cl.[2] ..... F02B 77/08

[52] U.S. Cl. ..... 123/198 DB; 123/DIG. 11

[58] Field of Search .... 123/198 D, 198 DC, 198 DB, 123/DIG. 11

[56] References Cited

U.S. PATENT DOCUMENTS

| | | | |
|---|---|---|---|
| Re. 27,108 | 3/1971 | Johnson et al. | 123/198 DB |
| 2,337,838 | 12/1943 | Reavis | 123/198 DC |
| 3,158,144 | 11/1964 | Walker | 123/198 DC |
| 3,533,390 | 10/1970 | Goodwin | 123/198 DB |
| 3,533,391 | 10/1970 | Lockmuller | 123/198 DB |
| 3,602,207 | 8/1971 | Kilmer | 123/198 D X |
| 3,680,539 | 8/1972 | Savage et al. | 123/198 DC X |
| 3,763,397 | 10/1973 | Yockers | 123/198 D X |

*Primary Examiner*—Charles J. Myhre
*Assistant Examiner*—Ira S. Lazarus
*Attorney, Agent, or Firm*—Francis L. Swanson

[57] ABSTRACT

An automotive engine ignition system which prevents either deliberate or accidental backfire when the ignition switch is shut off is disclosed. Means for automatically shutting off fuel to the carburetor and for limiting distributor timing is also disclosed.

7 Claims, 1 Drawing Figure

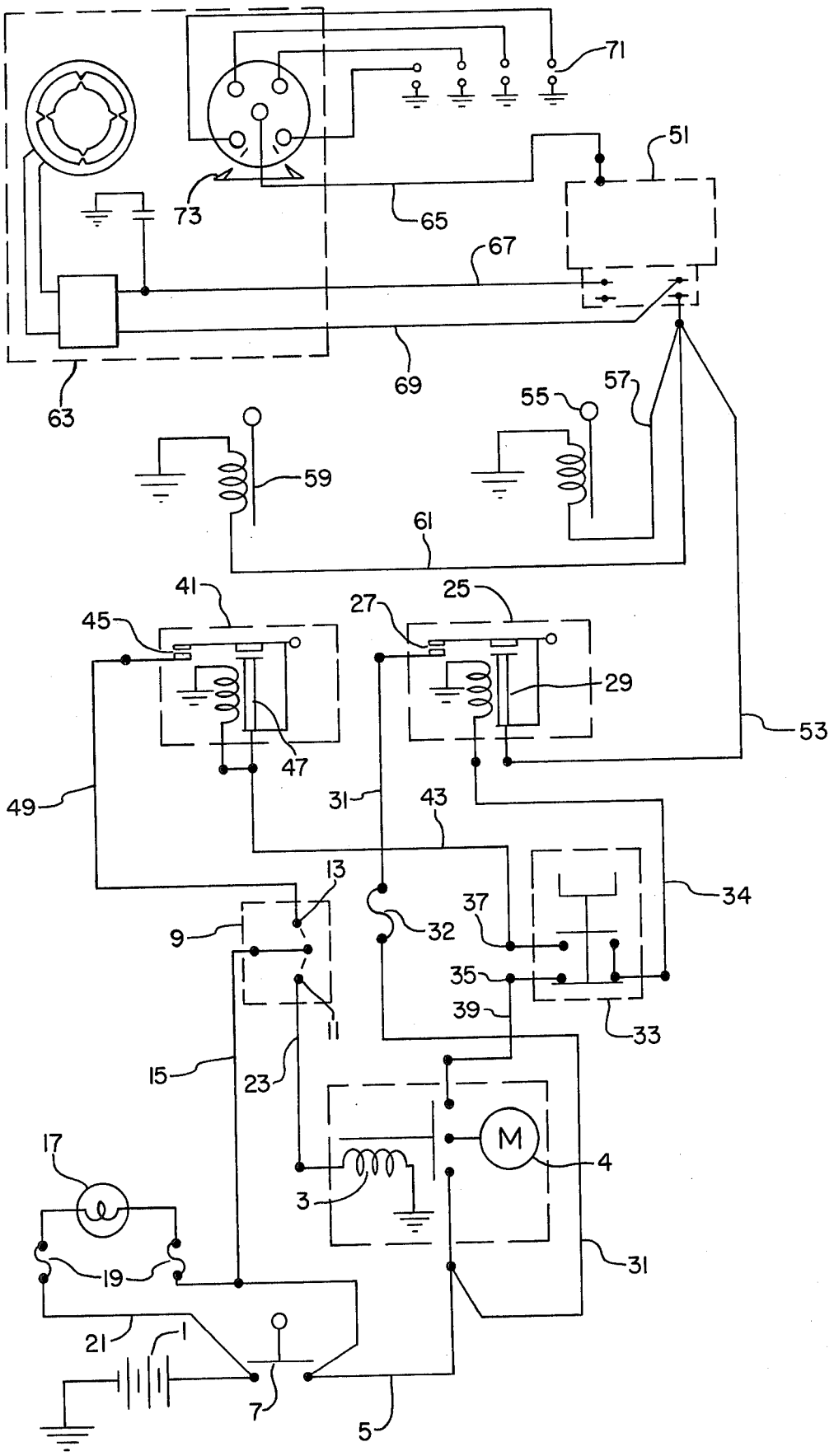
71
51
73
65
67
69
63
55
57
59
61
41
27
25
45
29
53
47
49
31
43
13
34
37
9
32
35
39
33
11
15
23
M
17
4
3
31
19
21
1
7
5

IGNITION SYSTEM WITH BACKFIRE PREVENTION

BACKGROUND OF THE INVENTION

1. Field of the Invention

The present invention pertains to automotive ignition systems in general and more particularly to those which prevent engine backfire.

2. Description of the Prior Art

Previous attempts at controlling the problem of backfire have either centered on precision control of the engine timing spark advance or have been directed to suppressing the flames and sparks which result from the backfire itself. Systems are also known which automatically shut off fuel supply, as in certain diesel turbine designs. Other systems lock out the ignition starter circuit until engine rpm falls below a predetermined value to prevent damage to the starter if re-engagement is attempted.

SUMMARY OF THE INVENTION

A principal object of the invention is to provide a means of preventing engine backfire due either to manipulation of the ignition switch off and on or due to field build-up in the exhaust system during engine shut-off and run down.

A further object of the invention is to provide an ignition system having dual electrical paths from the battery to the ignition coil.

A further object of the invention is to provide means sensitive to engine oil pressure for blocking power to the ignition coil.

A further object of the invention is to provide an ignition system which includes means for cutting off all major fuel supply sources to the engine, disabling the accelerator pump and closing the throttle when the ignition switch is shut off under any circumstances.

A further object of the invention is to provide an ignition system which includes means for limiting engine spark advance or retard between predetermined limits.

Throughout the following description other objects and advantages of the invention will become apparent to those skilled in the art.

BRIEF DESCRIPTION OF THE DRAWINGS

FIG. 1 is a detailed schematic drawing of the ignition system.

DETAILED DESCRIPTION

Referring now to the drawings, FIG. 1 is a schematic presentation of the ignition circuit which includes a battery (1) operatively connected to the starter solenoid (3) by wire (5). As used herein the word "wire" is intended to include any suitable conductor means and is not intended to be limited to wires having a solid conducting core surrounded by insulating material. A disconnect switch (7) is interposed between battery (1) and wire (5). An ignition start switch (9) having a "start" position (11) and a "run" position (13) is operatively connected to the disconnect switch (7) by wire (15).

Indicator light circuit comprising a light (17) and fuses (19) is operatively connected to the disconnect switch (7) and to wire (15) by wire (21).

Ignition start switch (9) is connected to starter solenoid (3) by wire (23).

A power relay (25) having contact points (27) which are operated by solenoid (29) is operatively connected to the starter solenoid (3) by wire (31) and fuse (32).

An oil pressure switch (33) is contained within the circuit and has a normally closed ten psi contact (35) and a normally open four psi contact (37). Pressure switch (33) is operatively connected to the starter solenoid (3) through the ten psi contact (35) via wire (39). Switch (33) is also operatively connected to an ignition lockout relay (41) via wire (43). Lockout relay (41) contains breaker points (45) which are operated by solenoid (47). Lockout relay (41) is operatively connected to ignition switch (9) by wire (49).

Power relay (25) is connected to the ignition coil (51) by wire (53). Ignition coil (51) is connected to a fuel shut-off solenoid (55) by wire (57). Coil (51) is also connected to an accelerator release solenoid (59) by wire (61). The coil (51) is also connected to the distributor (63) by wires (65), (67) & (69). The distributor (63) which is the breakerless type, is operatively connected to a series of spark plugs (71). It will be recognized by those skilled in the art that a conventional distributor having breaker points could be readily substituted for breakerless distributor (63).

OPERATION

In normal operation of the ignition circuit disconnect switch (7) is closed. When an operator desires to start the vehicle, ignition switch (9) is turned to the "start" position (11), electric power from the battery passes through wire (15) and (23) to starter solenoid (3). This causes the solenoid contacts to close permitting electric power to pass through wire (5) and wire (39) to the normally closed contact points (35) of oil pressure switch (33) and on through wire (34) to energize solenoid coil (29) of power relay (25). This action causes contact points (27) to close. Since wire (31) is connected to wire (5) and to contact points (27) of power relay (25) a path for current from battery (1) to the power relay is thus established. Wire (53) which is connected to the power relay through points (27) provides a path for electrical current to the coil (51). The ignition coil (51) in combination with wires (65), (67), (69) and distributor (63) provides current to fire the plugs (71).

As starting motor (4) cranks the engine, oil pressure will build until it reaches four psi. This pressure is sensed by the oil pressure switch (33) and the normally open four psi contacts (37) close. This closing provides an electrical path via wire (43) to the ignition lockout relay (41). Current flowing through line (43) energizes solenoid coil (47) which in turn closes contact points (45) and lockout relay (41) and provides continuity through line (49) back to the "run" position (13) of ignition switch (9). The power relay solenoid (29) now receives current from two sources: The first being through the starter solenoid (3) and the ten psi contact points (35) and the second through ignition lockout relay (41) and contact points (37). With contact points (27) closed current will now flow through line (31) and wire (53) to ignition coil (51).

As the oil pressure builds to ten psi, the normally closed contact points (35) in oil pressure switch (33) open and the electrical current path from the starter is broken. Current to solenoid (29) in power relay (25) is now supplied only through the ignition lockout relay (41) and the four psi contact (37) in the oil pressure switch (33).

When the ignition switch (9) is turned off - even momentarily - the lockout relay (41) opens and breaks the circuit supplying current through the four psi pressure switch to power relay (29) and to ignition coil (51). This interruption of current will cause fuel shut-off solenoid (55) to cut off fuel to the engine. Simultaneously, accelerator release solenoid (59) will disable the accelerator pump. The ignition coil (51), the shut-off solenoid (55) and accelerator release solenoid (59) can be re-energized only through the starter circuit after the engine rpm has fallen and the oil pressure dropped below ten psi. When pressure drops below ten psi, the contact points (35) in oil pressure switch (33) close and re-establishes a path for electric current from battery (1) to power relay solenoid (29). The engine can now be restarted. The four psi contact points (37) will close re-establishing the dual path previously described above and as the oil pressure builds past ten psi the points (35) in coil pressure switch (33) will open and a single electrical current path will be provided as described above. If the engine is again turned off the lockout relay will prevent re-starting until the proper oil pressure level has been sensed by pressure switch (33).

Having disclosed the preferred embodiment of our invention and described it in detail it will be apparent to those skilled in the art that many changes and modifications to the invention would be made without departing from its true scope and spirit. We claim all such changes and modifications as fall within the scope of the appended claims.

We claim:

1. An ignition and fuel supply control system for an internal combustion engine comprising:
- a source of electrical power;
- an ignition coil;
- at least two separate electrical power conducting paths simultaneously connecting the power source to the coil;
- an oil pressure sensitive switch responsive to two different values of engine oil pressure, the switch interposed within both paths for selectively interrupting power flow through either of the paths to the coil;
- means operatively connected to the coil for cutting off fuel to the engine when power through the pressure responsive means to the coil is interrupted;
- and means responsive to the ignition switch shut off to disable operation of a carburetor on the engine until oil pressure falls to a predetermined value.

2. Apparatus according to claim 1, wherein the carburetor includes an accelerator pump having release means responsive to cut-off of current to the coil so that when the current is cut-off, the pump becomes inoperative.

3. An ignition and fuel supply control system for an internal combustion engine comprising:
- a source of electrical power;
- an engine oil pressure sensitive switch;
- an ignition switch;
- an ignition coil;
- a plurality of current conducting paths simultaneously connecting the power source to the coil through the pressure sensitive switch, the conducting paths selectively interruptable by the pressure sensitive switch, the switch responsive to two different values of engine oil pressure;
- means operatively connected to the coil for cutting off fuel to the engine when power to the coil is interrupted;
- and means for disabling engine starting in response to ignition switch shut-off until engine oil pressure falls to a predetermined value.

4. Apparatus according to claim 3 wherein the means for disabling the engine start function includes an ignition relay interposed between the ignition switch and the engine oil pressure sensitive switch.

5. An engine ignition and fuel supply control system comprising:
- a source of electrical power;
- an ignition switch;
- an ignition coil;
- an engine oil pressure sensitive switch, the switch sensitive to two different values of oil pressure;
- a first current conducting path connecting the power source through the ignition switch and through the pressure sensitive switch to the ignition coil;
- a second separate current conducting path connecting the power source through the pressure sensitive switch to the ignition coil simultaneous with connection of the coil through the first path;
- and means operatively connected to the ignition coil to cut off fuel to the engine and to render a carburetor on the engine inoperable when current to the coil is interrupted.

6. Apparatus according to claim 5 wherein a power relay is interposed between the pressure sensitive switch and the coil.

7. An ignition and fuel supply system for an internal combustion engine comprising:
- a source of electrical current;
- an ignition coil;
- an ignition switch;
- a starter motor having a starter solenoid;
- an engine oil pressure sensitive switch, the switch sensitive to two different pressure values;
- a first electrical circuit connecting the current source through the ignition switch and through the pressure sensitive switch to the ignition coil, the first circuit interruptable by the pressure sensitive switch in response to a first oil pressure value sensed by said switch, the ignition switch further connected to the starter solenoid;
- a second electrical circuit connecting the current source through the starter solenoid through the pressure sensitive switch to the ignition coil, the second circuit interruptable by the pressure sensitive switch in response to a second oil pressure value sensed by said switch;
- means connected to the coil for cutting off fuel to the engine when current from the pressure sensitive switch to the coil is interrupted;
- and a lockout relay within the circuit responsive to shut-off of the ignition switch to disable restarting of the engine until engine oil pressure falls to a predetermined value.

* * * * *